United States Patent [19]

Bryant et al.

[11] 4,099,931

[45] Jul. 11, 1978

[54] HIGH DENSITY LIQUID RAMJET FUEL

[75] Inventors: James T. Bryant; George W. Burdette, both of China Lake, Calif.

[73] Assignee: The United States of America as represented by the Secretary of the Navy, Washington, D.C.

[21] Appl. No.: 294,068

[22] Filed: Oct. 2, 1972

[51] Int. Cl.[2] ..... C10L 1/04
[52] U.S. Cl. ..... 44/80
[58] Field of Search ..... 44/80; 208/15

[56] References Cited

U.S. PATENT DOCUMENTS

| | | | |
|---|---|---|---|
| 2,407,716 | 9/1964 | Marschner | 44/80 |
| 2,765,617 | 10/1956 | Gluesenkamp et al. | 208/15 |
| 3,113,419 | 12/1963 | Koch | 44/80 |
| 3,126,330 | 3/1964 | Zimmerschied et al. | 208/15 |
| 3,236,764 | 2/1966 | Den Herder et al. | 208/15 |

FOREIGN PATENT DOCUMENTS

| | | | |
|---|---|---|---|
| 527,765 | 7/1956 | Canada | 44/80 |
| 531,367 | 2/1924 | France | 44/80 |
| 169,428 | 6/1922 | United Kingdom | 44/80 |

OTHER PUBLICATIONS

Symposium on Jet Fuels, Amer. Chem. Soc., vol. 5, No. 4, Sep., 1960, p. C-52.

The Chemical Composition and Properties of Fuels for Jet Propulsion, Paushkin, 1962, pp. 129, 173.

"Symposium on Jet Fuels" taken from Preprints of the ACS, Div. of Petroleum Chemistry, pp. C-19 to C-58.

*Primary Examiner*—Winston A. Douglas
*Assistant Examiner*—Mrs. Y. Harris-Smith
*Attorney, Agent, or Firm*—R. S. Sciascia; Roy Miller; Lloyd E. K. Pohl

[57] ABSTRACT

Blends of Decalin with n-hexane, Tetralin with n-hexane and Tetralin with Decalin are useful as high density rocket ramjet and turbojet fuels under low temperature conditions.

3 Claims, No Drawings

HIGH DENSITY LIQUID RAMJET FUEL

BACKGROUND OF THE INVENTION

1. Field of the Invention

This invention relates to high density rocket ramjet and turbojet fuels. More particularly this invention relates to high density rocket ramjet and turbojet fuels suitable for use under low temperature conditions.

2. Description of the Prior Art

Specifications for certain ramjet and turbojet applications require that the fuel utilized have a high density and be easily ignitable and capable of sustaining combustion at temperature of −65° F and possibly lower. In applications such as ramjet rocket engines, specifications also call for fuels having highly reproducible properties. Suitable fuels should be stable and not deteriorate under a wide variety of shelf-life conditions.

Certain available fuels such as JP-4 are suitable for aircraft ramjet and turbojet operations at temperatures near −65° F. These fuels, however, do not have highly reproducible properties. That is, two barrels of JP-4 (or JP-5) may differ considerably in properties from one another. They are, therefore, undesirable for rocket ramjet and turbojet applications.

Certain other commercially available specially formulated fuels vary little in properties from barrel to barrel and are suitable for some rocket ramjet and turbojet applications. These fuels, however, have other problems associated with them. One problem is that most of the special formulations are not suitable for operation at −65° F. Another is that all of the special formulations are expensive. It is accordingly an objective of this invention to make available reproducible hydrocarbon fuels having properties which render them suitable for the above-described rocket ramjet and turbojet applications.

SUMMARY OF THE INVENTION

The fuels of this invention are essentially blends of Decalin (decahydonaphthalene) with n-hexane, Tetralin (tetrahydronaphthalene) with n-hexane and Tetralin with Decalin which freeze at slightly below −65° F. They meet specifications for ramjet missile engine fuels in that they exhibit highly reproducible properties, have high densities, and have flash points which permit ignition and sustained combustion at −65° F.

DESCRIPTION OF THE PREFERRED EMBODIMENTS

Both Decalin (decahydronaphthalene) and Tetralin (tetrahydronaphthalene) are completely miscible with n-hexane. The two naphthalene derivatives are also completely miscible with each other. Therefore, the fuel formulations of this invention may be prepared by mixing and stirring the ingredients.

A mixture of 95.2 weight percent decalin and 4.8 weight percent n-hexane freezes at a temperature below −65° F. A mixture of 80 weight percent Tetralin and 20 weight percent n-hexane freezes at below −65° F. A mixture of 70 weight percent Tetralin and 30 weight percent Decalin freezes at below −65° F. These are the three preferred fuel formulations of this invention. The addition of greater percentages of the minor component, of course, further lowers the freezing point. However, formulations which freeze at just below −65° F have been found to be preferable over other, lower freezing mixtures as rocket ramjet fuels because the addition of more of the minor component adversely effects the density and volumetric heating value of the fuel.

The following table compares a plurality of properties of the three above-described preferred fuels with the same properties of certain commercially available fuels. The percentages are weight percentages.

TABLE

| Fuel | Density | Freezing Point | Heat of Combustion Btu/gal | Viscosity Cps at −40° F |
|---|---|---|---|---|
| 95.2% Decalin/ 4.8% n-hexane | 0.87 | <−65° F | 134,000 | 13 |
| 70% Tetralin/ 30% Decalin | 0.95 | <−65° F | 138,000 | 16 |
| 80% Tetralin/ 20% n-hexane | 0.89 | <−65° F | 140,501 | — |
| JP-4 | 0.75–0.80 | −72° F | 115,000 | — |
| JP-5 | 0.79–0.85 | −51° F | 126,000 | 13 |
| Shelldyne-H | 1.099 | −38° F | 162,500 | — |
| TH-Dimer | 0.930 | −40° F | 143,000 | — |

It can be readily seen from the table that the densities of the preferred fuels of this invention are higher than those of the JP fuels and compare favorably with the special blends, Shelldyne-H and TH-Dimer. It can also be seen that the heats of combustion of the preferred fuels exceed those of the JP fuels and compare with those of the special blends. It can further be seen that the freezing points of the specially blended fuels do not approach −65° F.

Tests with the fuel mixtures of this invention have revealed no deterioration upon standing under shelf-life conditions at temperatures ranging from −65° F to +165° F for long periods of time. The flash points of the preferred fuels are such that they easily ignite at −65° F as well as at higher temperatures. Since the fuels of this invention are mixed from chemical materials which can be easily obtained in relatively pure form, the properties of the fuels are highly reproducible. From the foregoing discussion it might appear possible to use other fairly low molecular weight alkanes such as certain heptanes and octanes in place of the n-hexane used. While other alkanes could possibly be used to replace the n-hexane in the Tetralin-n-hexane and Decalin-n-hexane mixtures disclosed, larger percentages of them would be required in order to achieve comparable flash points and this would adversely lower both the density and the heating value of the fuel mixture produced. It should accordingly be emphasized here that the preferred mixtures described above and in the appended claims have an almost ideal balance of physical properties for rocket ramjet and turbojet applications. It will, however, be apparent that the percentages of the fuel ingredients could be varied slightly without producing large adverse effects on the fuel properties.

We claim:

1. A fuel mixture consisting essentially of 95.2 weight percent decahydronaphthalene and 4.8 weight percent n-hexane.

2. A fuel mixture consisting essentially of 80 weight percent tetrahydronaphthalene and 20 weight percent n-hexane.

3. A method for propelling a rocket ramjet or turbojet engine comprising the steps of:

(a) injecting a fuel selected from the group consisting of a blend of decahydronaphthalene with n-hexane and tetrahydronaphthalene with n-hexane which freezes at a temperature just under −65° F into said engine; and (b) igniting said fuel.

* * * * *